United States Patent [19]

Gronholz et al.

[11] Patent Number: 4,533,255

[45] Date of Patent: Aug. 6, 1985

[54] PROCESS FOR MIXING LIQUID SAMPLES TO BE ANALYZED, AS WELL AS APPARATUS FOR PERFORMING THIS PROCESS

[75] Inventors: Claus Gronholz; Hartmut Schmidt-Rabenau, both of Hamburg, Fed. Rep. of Germany

[73] Assignee: Eppendorf Geratebau Netheler & Hinz GmbH, Hamburg, Fed. Rep. of Germany

[21] Appl. No.: 507,674

[22] Filed: Jun. 24, 1983

[30] Foreign Application Priority Data

Jul. 1, 1982 [DE] Fed. Rep. of Germany ..... 3224583

[51] Int. Cl.[3] ..... B01F 13/02; B01F 11/00

[52] U.S. Cl. ..... 366/108; 137/209; 366/116

[58] Field of Search ..... 360/108, 124, 127, 600, 360/275, 349, 348, 101, 106, 116; 422/99; 73/671, 662; 137/209

[56] References Cited

U.S. PATENT DOCUMENTS

| | | | |
|---|---|---|---|
| 2,808,318 | 10/1957 | Feick | 366/100 |
| 3,544,074 | 12/1970 | Karpacheva | 366/124 |
| 3,637,115 | 1/1972 | Holm | 366/108 |

FOREIGN PATENT DOCUMENTS

| | | |
|---|---|---|
| 1598514 | 4/1975 | Fed. Rep. of Germany . |
| 2651356 | 5/1978 | Fed. Rep. of Germany . |

OTHER PUBLICATIONS

*Chemical Abstracts,* vol. 89, 1978, p. 217.

*Primary Examiner*—Robert W. Jenkins

*Attorney, Agent, or Firm*—Lane, Aitken and Kananen

[57] ABSTRACT

In a process for mixing liquid samples to be analyzed, the liquid sample contained in a sample container is moved and mixed by a mechanically oscillated air column in contact with at least part of the liquid sample surface, the air column being excited with a frequency in the resonant range of the system formed by the air column and the sample liquid.

9 Claims, 3 Drawing Figures

PROCESS FOR MIXING LIQUID SAMPLES TO BE ANALYZED, AS WELL AS APPARATUS FOR PERFORMING THIS PROCESS

BACKGROUND OF THE INVENTION

The invention relates to a process for mixing liquid samples to be analysed, in which the liquid sample is placed in a sample container, particularly in a cuvette or cell, and is moved and mixed by an air column that is mechanically oscillated and is in contact with at least part of the liquid sample surface.

In a known process of this type (German Pat. No. 15 98 514), used for performing blood examinations, the liquid to be examined is placed in one leg of a receiving container and the reagent liquid to be added is placed in the other leg of the container, the two legs being interconnected by a capillary channel in the container bottom area. The mouthpiece of a hose is sealingly placed on the opening of one leg and is connected to the cylinder area of a piston pump, so that by a compression movement of the pump piston, the liquid is forced out of the leg carrying the mouthpiece through the capillary channel into the other leg and then, in the case of a corresponding reversal of the piston movement, i.e., during an expansion movement, is sucked back through the capillary channel into the leg carrying the mouthpiece. The frequency of the pump piston movement is preferably 1 Hz.

Quite apart from the fact that in this process a very specially constructed receiving container is required, mixing only takes place very slowly, so that mixing times of approximately 10 seconds are required and this must be followed by settling times of approximately 3 to 4 seconds. Due to this long period of time, which is obviously disadvantageous for the rapid performance of mixing processes, said process is made particularly unsuitable for so-called kinetic measurements, as are used to an increasing extent in clinical and medical laboratories, in which the time sequence of the reaction must be measured within a sample and said reaction process starts immediately following the mixing of the sample constituents.

In another known process (DE-OS No. 26 51 356), sample containers with receiving legs are used in a similar way and are interconnected by narrow channels. Due to the recycling between the receiving legs, a large amount of turbulence occurs in the vicinity of the narrow connecting channels and this leads to intermixing. However, here again, both the mixing time and the settling time are very long.

It is also already known to intermix liquid samples by using ultrasonics, for which purpose an ultrasonic exciter is conventionally brought into direct contact with the liquid sample. This very rapidly leads to a very good intermixing, but such a process frequently cannot be used with liquid samples to be analysed, e.g. from the clinical sector, because these liquid samples contain high molecular weight substances which would be destroyed by ultrasonic action.

SUMMARY OF THE INVENTION

The problem of the present invention is to provide a process for mixing liquid samples to be analyzed which enables short mixing and settling times to be attained, accompanied by reduced stressing of the sample constituents.

According to the invention, this problem is solved in the case of a process of the aforementioned type in that the air column is excited with a frequency in the resonant range of the system comprising the air column and the sample liquid.

It has surprisingly been found that in the case of such an excitation of the air column in the resonant range, preferably with precisely the resonant frequency, only a relatively limited movement of the liquid sample surface takes place, as compared with the recycling movements in the known processes, and within the liquid sample there is a clear vortexing action which brings about mixing. For example, in the case of a liquid sample of approximately 300 $\mu$l to be examined photometrically in a clinical laboratory, complete mixing takes place within approximately 1.5 seconds, whereas in the aforementioned, known mixing processes mixing times of approximately 10 seconds are required. In these known processes, the mixing time must be followed by a settling time of between approximately 3 and 4 seconds, before a photometric measurement can be performed. Surprisingly, in the case of a liquid sample mixed by the process according to the invention, this settling time is only about 1 second. Thus, the process according to the invention is particularly suitable for mixing liquid samples, in which clinical sequences have to be analyzed. In addition, it leads to an increase in the mixing efficiency compared with known processes.

Generally, in a given apparatus, the length and crossection of the air column to be excited are constant and the frequency is then set in accordance with the sample liquid quantity.

Preferably, during each mixing process, the frequency is varied to pass through a narrow frequency range, which contains the resonant frequency.

The air column can be excited by means of an airtight diaphragm which seals the air column at its end remote from the liquid sample surface. The diaphragm used is preferably that of a loudspeaker which, in simple manner, by regulating the frequency of the voltage exciting it can be brought into the resonant range of the particular system.

The mixing time of the liquid sample, in the case of a given amplitude of the diaphragm exciting the air column, is dependent on the liquid viscosity and to obtain minimum mixing times, the oscillation amplitude of the diaphragm can be set as a function of the viscosity of the liquid sample.

An apparatus for performing the process according to the invention preferably uses the airtight diaphragm of a loudspeaker as the oscillation exciter.

BRIEF DESCRIPTION OF THE DRAWINGS

The invention is described in greater detail hereinafter relative to particular embodiments and the attached drawings which show.

DETAILED DESCRIPTION OF THE PREFERRED EMBODIMENTS

Figure 1:
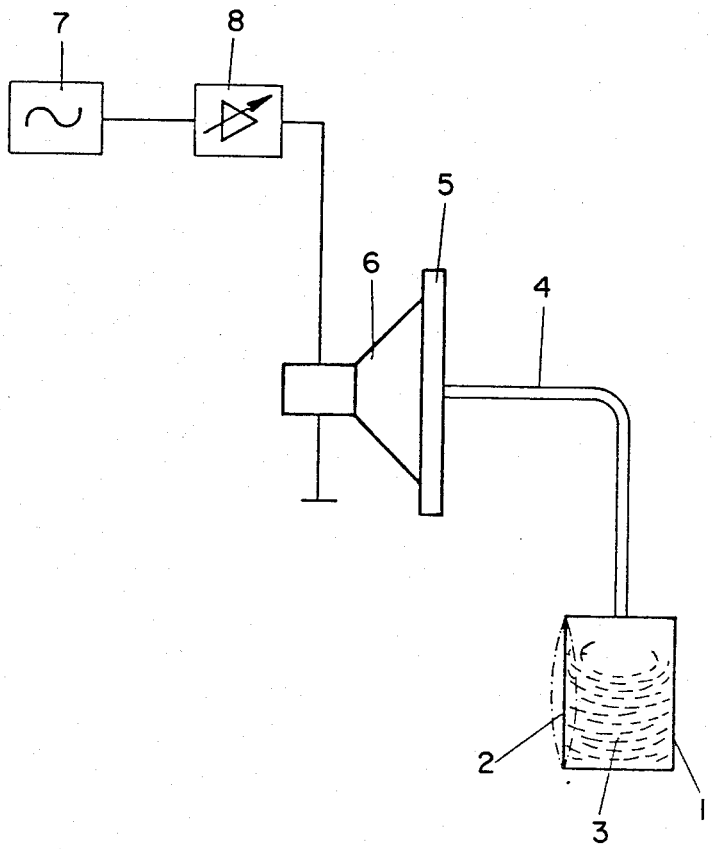
FIG. 1 a simplified embodiment of an apparatus according to the invention.

In the embodiment of FIG. 1, a cuvette or cell 1 is used having a sidewall 2 made from elastic material, which is at right angles to the sidewalls to be irradiated during a photometric measurement and which under pressure action can be deformed in the manner indicated by the dot-dash lines. For example, such cuvettes are used in the DuPont ACA-system. After introducing the liquid sample 3 or the different constituents of a sample, the filling opening of cuvette 1 is tightly sealed by means of a mixing head, which is not shown in detail, so that the inner area of the cuvette is only connected to one end of a tube or hose 4 with scarcely deformable walls. The other end of the tube or hose 4 is connected to a connection plate 5, which is sealingly placed on the opening of a loudspeaker 6, which has an airtight diaphragm, e.g. a plastic diaphragm. The loudspeaker is energized by a variable frequency signal power source 7 supplying a sine-wave alternating current voltage by means of an amplifier 8 having an adjustable gain. The signal voltage of power source 7 leads to an oscillation of the diaphragm of loudspeaker 6, whose frequency is dependent on the set frequency of power source 7 and whose amplitude is dependent on the set gain of amplifier 8.

For performing a mixing operation, the liquid sample or the consituents thereof to be mixed are placed in cuvette 1 and the latter is then sealed with the mixing head. Loudspeaker 6 is then subject to the action of the signal voltage, so that the oscillating loudspeaker diaphragm oscillates the air column in the connected tube or hose with a corresponding frequency. The frequency of the signal power source 7 is set in such a way that it is in the resonant range of the system formed by the air column in the tube or hose 4 and the liquid sample 3. This resonant range is dependent on the volume of the air column, as well as the volume and density of the liquid in the sample, optimum mixing being obtained on setting the resonant frequency. As a result of the oscillation of the air column, the liquid sample 3 is also excited to oscillate at the frequency and the sidewall 2 is thereby deformed in the indicated manner. There is a definite vortexing of sample 3.

It has been found that when carrying out mixing processes in cuvettes, the resonant frequencies of the system formed by the air column and the liquid sample can be in the range of 10 to 20 Hz.

Figure 2:
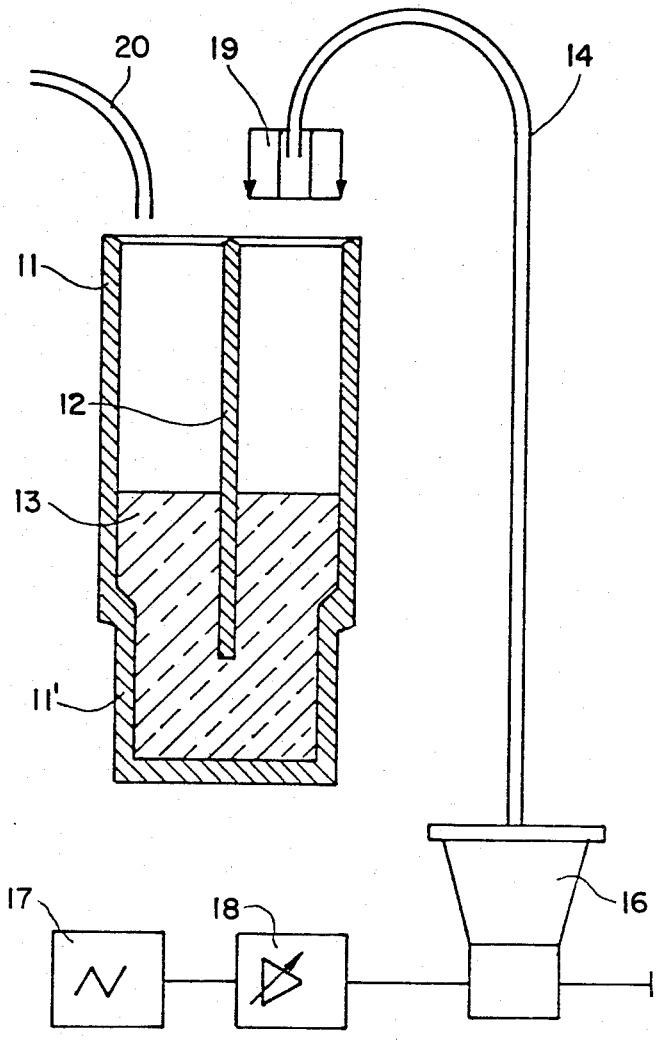
FIG. 2 an apparatus modified compared with that of FIG. 1.

In FIG. 2, liquid sample 13 is filled into a U-shaped cuvette 11, whose legs are separated by a partition 12, so that the two legs are only interconnected below said partition. The lower part 11' of cuvette 11 has facing, planar, transparent wall areas, through which photometric measurements can take place in the conventional way.

A liquid sample 13 is placed in cuvette 11 and by means of a hose 20 a reagent is supplied thereto for initiating a reaction sequence. For the intermixing of liquid sample 13, a mixing head 19 can be sealingly placed on the right-hand leg of cuvette 11 in FIG. 2. A hose or tube 14 is connected to mixing head 19 and its other end is connected, in the manner described relative to FIG. 1, to the airtight diaphragm of a loudspeaker 16. As was also described in connection with FIG. 1, this loudspeaker 16 is excited by means of an a.c. voltage source 17 supplying a triangular signal voltage and an amplifier 18 in the resonant range of the system formed by the air column and the sample liquid. As a result of this excitation, the air column, partly surrounded by the hose or tube 14 and located between the surface of sample 13 and the diaphragm of loudspeaker 16 is oscillated in accordance with the frequency and amplitude of the loudspeaker diaphragm, the mixing process taking place in substantially the same way as described in connection with the embodiment of FIG. 1.

During a test, a loudspeaker of type AD 0198 Z 25 of the Valvo company was used and excited an air column of length 65 mm and volume 205 $mm^3$ located in a hose or tube 14. The connected U-shaped cuvette 11 received a 330 $\mu$l liquid sample 13. The resonant frequency was approximately 18 Hz and a very strong intermixing was achieved after exciting for only 1.5 seconds. The vortexing of the liquid sample, which could be seen from the outside during this intermixing, had completely disappeared after about 1 second, so that the sample could be photometrically examined in area 11'.

Figure 3:
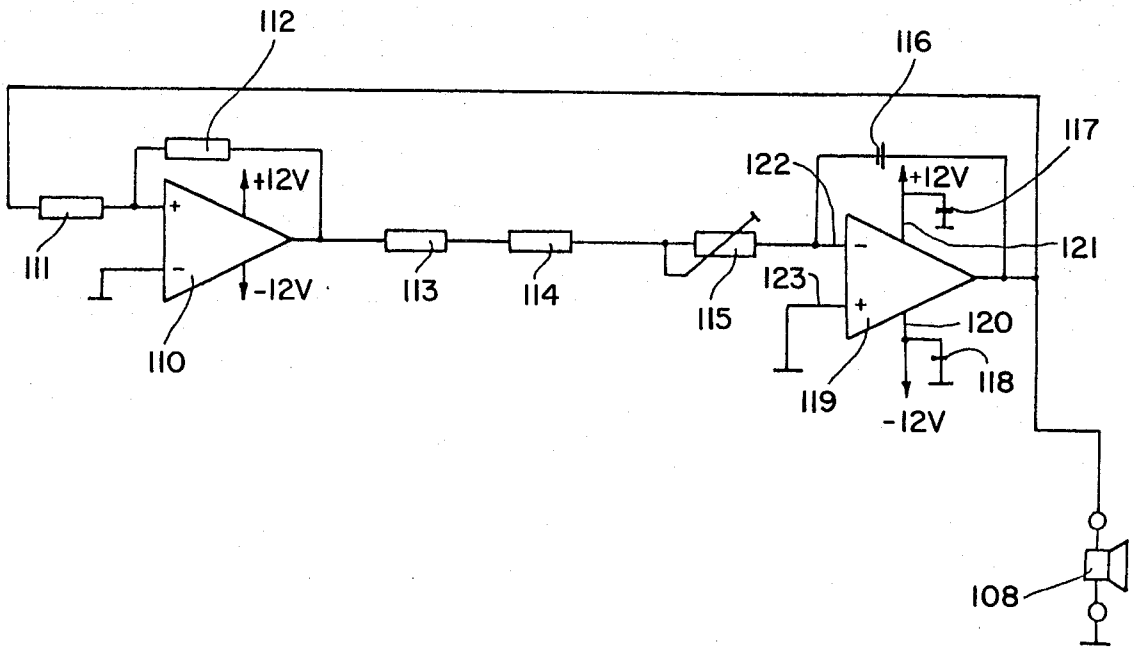
FIG. 3 a circuit for exciting the loudspeaker in apparatuses according to FIGS. 1 or 2.

A circuit arrangement, like that shown in FIG. 3 for exciting a loudspeaker 108, can be used for exciting loudspeaker 6 in FIG. 1, or loudspeaker 16 in FIG. 2. This circuit contains an a.c. voltage source in the form of an amplifier, which can be an integrated circuit of type LM 741 manufactured by National Semiconductor. Supply voltages of +12 V and −12 V are applied to said amplifier and it is connected by means of resistors 111 and 112 in the manner of a Schmitt trigger and in operation consequently produces rectangular output signals.

A power amplifier 119, e.g. of type L 165 of Siemens AG is connected in series with amplifier 110 across resistors 113 and 114, together with a potentiometer 115. As shown, supply voltages of +12 V and −12 V are applied to said amplifier and for suppressing interference capacitors 117 and 118 are connected to leads 120 and 121 for the supply voltage. A capacitor 116 is connected between input 122 and the output of amplifier 119. Together with resistors 113, 114 and potentiometer 115, capacitor 116 forms an integrating network. The output of amplifier 119 is connected to loudspeaker 108.

If amplifier 110, which functions as a Schmitt trigger, supplies the positive side of a square-wave pulse, the integrating network produces a falling voltage at output of amplifier 119. A negative side of the square-wave pulse supplied by amplifier 110 reverses the output slope, so that a positively rising voltage appears at the output of amplifier 119. In this way, a triangular output signal is produced at the output of amplifier 119 and excites loudspeaker 108 as an alternating current voltage.

The frequency of the triangular output signal of amplifier 119 can be varied with the aid of potentiometer 115, so that an adaptation to the prevailing operating conditions and a passage through a resonant range are possible.

While the present invention has been described in terms of certain specific embodiments, it should be understood that numerous modifications to these embodiments could be made which would be within the scope of the present invention.

What is claimed is:

1. A process for mixing liquid samples to be analyzed, in which a liquid sample is placed in a sample container adjacent to and moved and mixed by an air column, the air column being mechanically oscillated and in contact with at least part of the liquid sample surface, wherein the air column is excited with a frequency that causes the system, comprising the air column and the sample liquid, to resonate.

2. The process according to claim 1, wherein said sample container is a cuvette or cell.

3. A process according to claim 1, in which the length and cross-section of the air column are kept constant, wherein the frequency is set in accordance with the quantity of the sample liquid.

4. A process according to claim 1, wherein the frequency passes through a narrow frequency range containing the resonant frequency, during each mixing process.

5. A process according to claim 1, wherein the air column is excited by an airtight diaphragm, which seals the air column at its end remote from the surface of the liquid sample.

6. A process according to claim 5, wherein a loudspeaker diaphragm is used as a diaphragm.

7. A process according to claim 5, wherein the oscillation amplitude of the diaphragm is chosen as a function of the viscosity of the liquid sample.

8. An apparatus for performing the process according to claim 5, in which said sample container is a cuvette and a mixing head is placed on said cuvette and to said mixing head is connected a tube or hose, the other end of which is connected to an oscillation exciter, wherein the oscillation exciter is the airtight diaphragm of a loudspeaker.

9. An apparatus for mixing liquid samples to be analyzed comprising a cuvette, a mixing head placed on said cuvette, a tube or hose connected at one end to said mixing head, and an airtight diaphragm of a loudspeaker connected at the other end of said tube or hose, such that said cuvette is adapted to receive a liquid sample having a surface and said apparatus is adapted to contain an air column extending from said diaphragm to said surface, wherein said diaphragm is adapted to mechanically oscilate with a frequency in the resonant range of a system comprising said air column and said sample.

* * * * *